US011840866B2

(12) United States Patent
Miller et al.

(10) Patent No.: US 11,840,866 B2
(45) **Date of Patent: *Dec. 12, 2023**

(54) BOLT MECHANISM WITH DOOR POSITION SENSOR

(71) Applicant: Schlage Lock Company LLC, Carmel, IN (US)

(72) Inventors: Benjamin Miller, Indianapolis, IN (US); Tejas V. Kumar, Bangalore (IN)

(73) Assignee: Schlage Lock Company LLC, Carmel, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/879,433

(22) Filed: Aug. 2, 2022

(65) Prior Publication Data

US 2022/0364390 A1 Nov. 17, 2022

Related U.S. Application Data

(63) Continuation of application No. 16/668,778, filed on Oct. 30, 2019, now Pat. No. 11,401,734.

(51) Int. Cl.

| | |
|---|---|
| ***E05B 55/00*** | (2006.01) |
| ***E05B 45/12*** | (2006.01) |
| ***E05B 47/00*** | (2006.01) |
| ***E05B 15/02*** | (2006.01) |
| ***E05B 55/12*** | (2006.01) |
| ***E05B 17/20*** | (2006.01) |
| *E05B 45/06* | (2006.01) |

(52) U.S. Cl.

CPC ..... *E05B 55/005* (2013.01); *E05B 15/0205* (2013.01); *E05B 17/2026* (2013.01); *E05B 45/12* (2013.01); *E05B 55/12* (2013.01); *E05B 2045/0665* (2013.01); *E05B 2047/0069* (2013.01)

(58) Field of Classification Search

CPC ..... E05B 15/02; E05B 15/0205; E05B 15/04; E05B 17/2026; E05B 17/2038; E05B 17/2088; E05B 45/08; E05B 45/12; E05B 2045/0665; E05B 2047/0067; E05B 2047/0069; E05B 55/005; E05B 55/12

See application file for complete search history.

(56) References Cited

U.S. PATENT DOCUMENTS

| | | | | |
|---|---|---|---|---|
| 3,934,437 | A | 1/1976 | Crepinsek | |
| 4,729,585 | A | 3/1988 | Lin | |
| 5,925,861 | A * | 7/1999 | Fromberg | E05B 45/12 200/61.67 |
| 6,241,294 | B1 | 6/2001 | Young et al. | |
| 6,304,177 | B1 | 10/2001 | Nigro, Jr. et al. | |
| 6,441,735 | B1 | 8/2002 | Marko et al. | |
| 7,165,428 | B2 | 1/2007 | Isaacs et al. | |
| 8,686,869 | B2 | 4/2014 | Sharma et al. | |

(Continued)

*Primary Examiner* — Christopher J Boswell

(74) *Attorney, Agent, or Firm* — Taft Stettinius & Hollister LLP

(57) ABSTRACT

An exemplary bolt assembly includes a housing, a bolt, and a magnetic sensor. The housing includes a tubular sleeve configured for mounting in a latch bore of a door. The bolt is movably mounted to the housing for movement between an extended position and a retracted position. The magnetic sensor includes wires that extend through the tubular sleeve, and is operable to transmit information relating to an open/closed position of the door.

16 Claims, 5 Drawing Sheets

(56) References Cited

U.S. PATENT DOCUMENTS

| | | | | |
|---|---|---|---|---|
| 9,353,550 | B1 | 5/2016 | Smith, III | |
| 9,617,757 | B2 | 4/2017 | Lowder | |
| 9,631,920 | B2 * | 4/2017 | Goldenson | E05B 45/083 |
| 9,845,621 | B2 | 12/2017 | Lowder | |
| 9,920,552 | B2 | 3/2018 | Lowder | |
| 10,287,801 | B1 | 5/2019 | Huang | |
| 10,435,917 | B2 * | 10/2019 | Nunez | E05B 47/0038 |
| 10,550,601 | B2 | 2/2020 | Baumgarte et al. | |
| 11,053,710 | B2 | 7/2021 | Haussler | |
| 11,199,026 | B2 | 12/2021 | Chen | |
| 2005/0044908 | A1 * | 3/2005 | Min | E05B 47/0012 70/432 |
| 2006/0192396 | A1 | 8/2006 | Frolov et al. | |
| 2009/0066320 | A1 | 3/2009 | Posey | |
| 2009/0090148 | A1 | 4/2009 | Kollin et al. | |
| 2009/0193859 | A1 | 8/2009 | Kwon et al. | |
| 2012/0167646 | A1 * | 7/2012 | Sharma | E05B 17/22 356/399 |
| 2012/0299314 | A1 | 11/2012 | Jiang | |
| 2017/0226774 | A1 * | 8/2017 | Goldenson | E05B 45/083 |
| 2017/0362856 | A1 | 12/2017 | Almomani et al. | |
| 2018/0155959 | A1 * | 6/2018 | Hartung | E05B 17/10 |
| 2018/0340352 | A1 | 11/2018 | Compton | |
| 2019/0040653 | A1 | 2/2019 | Baumgarte et al. | |
| 2020/0011091 | A1 | 1/2020 | Chen | |

* cited by examiner

BOLT MECHANISM WITH DOOR POSITION SENSOR

CROSS REFERENCE TO RELATED APPLICATIONS

This application is a continuation of U.S. patent application Ser. No. 16/668,778 filed Oct. 30, 2019 and issued as U.S. Pat. No. 11,401,734, the contents of which are hereby incorporated herein by reference in their entirety.

TECHNICAL FIELD

The present disclosure generally relates to door position sensors, and more particularly but not exclusively relates to latch mechanisms having integrated door position sensors.

BACKGROUND

Certain existing electronic locksets include door position sensors by which the open/closed position of the door can be sensed. Many existing door position sensors suffer from a variety of drawbacks and limitations, such as those related to ease of installation. For example, while doors typically come prepared with a standard door preparation including a cross-bore and a latch bore, many existing door position sensing solutions require that additional bores be drilled in the door and/or the doorframe. For these reasons among others, there remains a need for further improvements in this technological field.

SUMMARY

An exemplary bolt assembly includes a housing, a bolt, and a magnetic sensor. The housing includes a tubular sleeve configured for mounting in a latch bore of a door. The bolt is movably mounted to the housing for movement between an extended position and a retracted position. The magnetic sensor includes wires that extend through the tubular sleeve, and is operable to transmit information relating to an open/closed position of the door. Further embodiments, forms, features, and aspects of the present application shall become apparent from the description and figures provided herewith.

DETAILED DESCRIPTION OF ILLUSTRATIVE EMBODIMENTS

Figure 1:
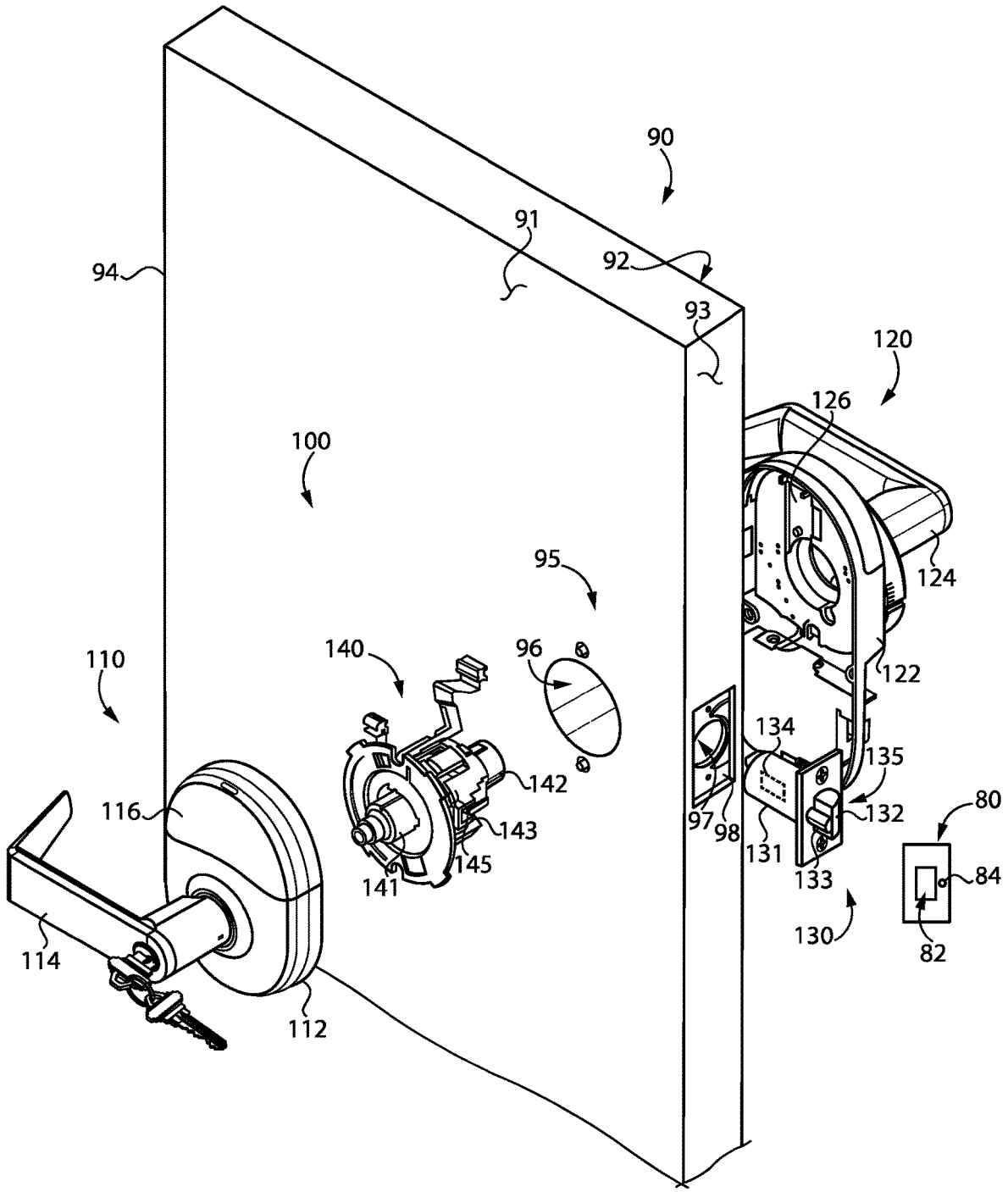
FIG. 1 is an exploded assembly view of a door having installed thereto a lockset according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Items listed in the form of "A, B, and/or C" can also mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not necessarily be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may be omitted or may be combined with other features.

The disclosed embodiments may, in some cases, be implemented in hardware, firmware, software, or a combination thereof. The disclosed embodiments may also be implemented as instructions carried by or stored on one or more transitory or non-transitory machine-readable (e.g., computer-readable) storage media, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

With reference to FIG. 1, illustrated therein is a door 90 having installed thereon a lockset 100 according to certain embodiments. The door 90 includes an outer side 91, an inner side 92 opposite the outer side 91, a free edge 93, and a hinge edge 94 opposite the free edge 93. The door 90 further includes a standard door preparation 95 including a cross-bore 96 extending between the outer side 91 and the inner side 92, and a latch bore 97 extending from the free edge 93 to the cross-bore 96.

The door 90 is pivotably mounted to a doorframe including a hinge jamb adjacent the hinge edge 94 and a latch jamb that is adjacent the free edge 93 when the door 90 is in a closed position. The door 90 is mounted to the doorframe by a set of hinges that are mounted to the hinge edge 94 and the hinge jamb. The latch jamb has mounted thereon a strike plate 80 including an opening 82 operable to receive a latchbolt 132 of the lockset 100. In certain embodiments, the strike plate 80 may have mounted thereon a magnet 84.

The lockset 100 is configured for mounting to the standard door preparation 95, and generally includes an outside assembly 110 configured for mounting to the outer side 91, an inside assembly 120 configured for mounting to the inner side 92, a latchbolt assembly 130 configured for mounting in the latch bore 97, and a chassis assembly 140 configured for mounting in the cross-bore 96. When assembled, each of the outside assembly 110, the inside assembly 120, and the latchbolt assembly 130 is operably connected with the chassis assembly 140 such that the latchbolt assembly 130 can be actuated by the outside assembly 110 and/or the inside assembly 120.

The outside assembly 110 generally includes an outside escutcheon 112 and an outside handle 114 rotatably mounted to the outside escutcheon 112, and may further include a credential reader 116 mounted to the outside escutcheon 112. While the illustrated outside handle 114 is provided in the form of a lever, it is also contemplated that the outside handle 114 may be provided in the form of a knob. The credential reader 116 may be provided in any of a number of forms, including but not limited to a card reader, a mobile device reader, a biometric reader, and other forms of readers.

The inside assembly 120 generally includes an inside escutcheon 122, an inside handle 124 rotatably mounted to the inside escutcheon 122, and a control assembly 126 mounted to the inside escutcheon 122. While the illustrated inside handle 124 is provided in the form of a lever, it is also contemplated that the inside handle 124 may be provided in the form of a knob. As described herein, the control assembly 126 is in communication with a door position sensor of the lockset 100 and is operable to detect the open/closed position of the door 90 based upon information received from the door position sensor. Additionally or alternatively, the door position sensor of the lockset 100 may be in communication with an external device, such as a gateway, a mobile device, an access control system, a smart home system, or another form of external device.

The latchbolt assembly 130 includes a housing 131 and a latchbolt 132 movably mounted to the housing 131 for movement between an extended position and a retracted position, and may further include a deadlatch plunger 133 movably mounted to the housing 131 for movement between a projected position and a depressed position. The latchbolt 132 is biased toward its extended position, and the deadlatch plunger 133 is biased toward its projected position. In the illustrated form, the latchbolt assembly 130 further includes a deadlock mechanism 134 configured to prevent externally-applied pushing forces from moving the latchbolt 132 from the extended position to the retracted position when the plunger 133 is in its depressed position. As described herein, the latchbolt assembly 130 may further include a door position sensor 135 operable to sense the open/closed position of the door 90.

The chassis assembly 140 generally includes an outside spindle 141 operably connected with the outside handle 114, an inside spindle 142 operably coupled with the inside handle 124, and a retractor 143 operably coupled with the latchbolt 132. The retractor 143 is engaged with the spindles 141, 142 such that each of the spindles 141, 142 is at least selectively operable to drive the retractor 143 in a retracting direction to provide for retraction of the latchbolt 132. In certain embodiments, the chassis assembly 140 further includes a door position sensor 145 operable to sense the position of the door 90.

When the door 90 is in its closed position, the latchbolt 132 is operable to extend into the opening 82 of the strike 80 to latch the door 90 in its closed position. In this state, the deadlatch plunger 133 is engaged with the strike plate 80 such that the strike plate 80 retains the deadlatch plunger 133 in its depressed position, thereby activating the deadlock mechanism 134. As a result, the deadlock mechanism 134 prevents externally-applied pushing forces from driving the latchbolt 132 to its retracted position. However, the inside handle 124 remains operable to retract the latchbolt 132. When the lockset 100 is in an unlocked state, the latchbolt 132 can also be retracted by the outside handle 114.

Figure 2:
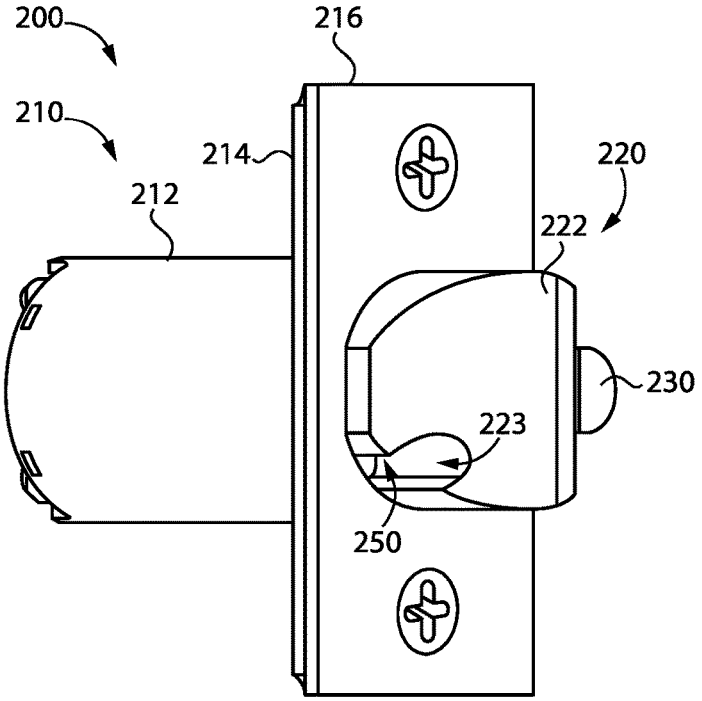
FIG. 2 is a perspective view of a latchbolt assembly according to certain embodiments.
Figure 3:
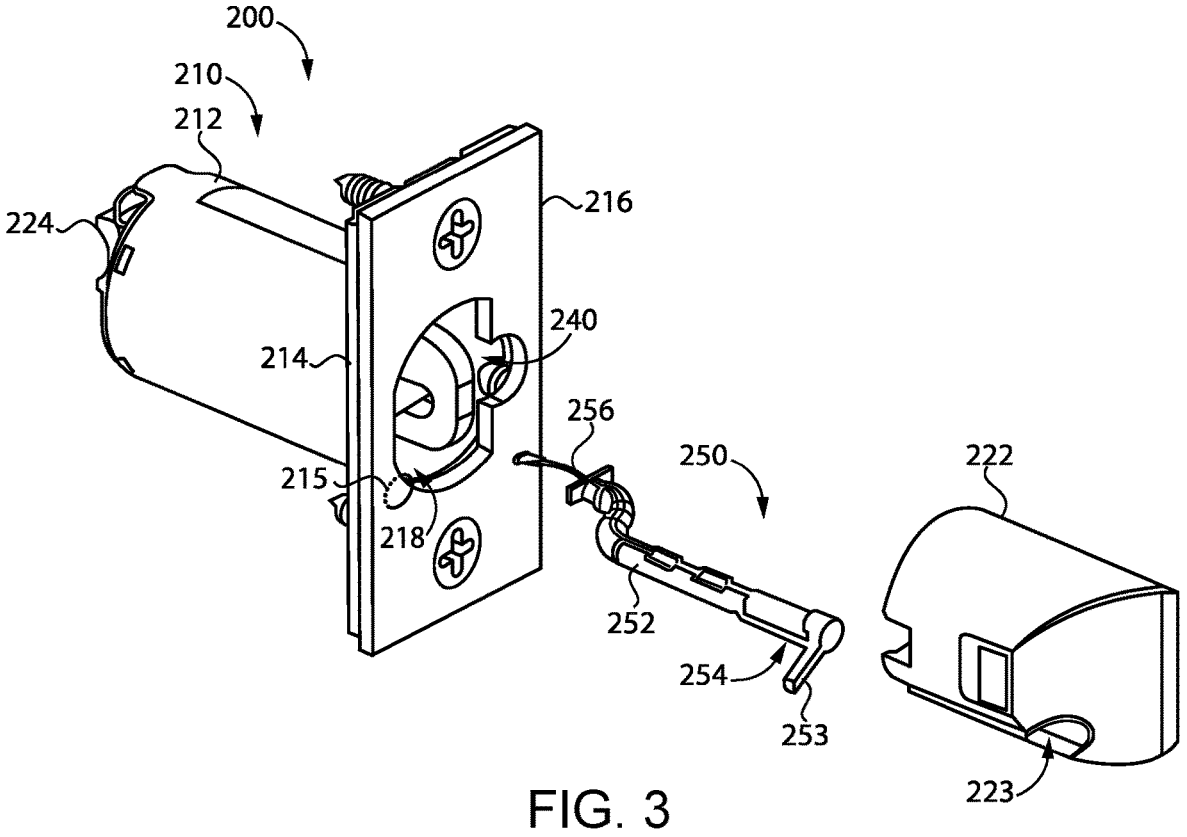
FIG. 3 is a partially-exploded view of the latchbolt assembly illustrated in FIG. 2.

With additional reference to FIGS. 2 and 3, illustrated therein is a latchbolt assembly 200 according to certain embodiments, which may be utilized as the latchbolt assembly 130 of the lockset 100. The latchbolt assembly 200 generally includes a housing 210 and a latchbolt 220 movably mounted to the housing 210 for movement between an extended position and a retracted position. The latchbolt assembly 200 may further include a deadlatch plunger 230 movably mounted to the housing 210 and engaged with a deadlock mechanism 240. The latchbolt assembly 200 further includes a door position sensor (DPS) assembly 250 operable to detect the open/closed position of the door 90 by cooperating with the strike-mounted magnet 84.

The housing 210 generally includes a tubular sleeve 212 sized and shaped to be received in the latch bore 97, an inner faceplate 214 mounted to the sleeve 212, and an outer faceplate 216 mounted to the inner faceplate 214. The inner faceplate 214 may include a recess 215 that is covered by the outer faceplate 216. The faceplates 214, 216 are sized and shaped to be received in a recess 98 of the door preparation 95 such that the outer faceplate 216 sits substantially flush with the free edge 93. The housing 210 further includes an opening 218 through which the latchbolt 220 is operable to project.

The latchbolt 220 is movably mounted in the tubular sleeve 212 and is operable to project through the opening 218 when in its extended position. The latchbolt 220 includes a bolt head 222 and a bolt bar 224 operably connecting the bolt head 222 with the retractor 143 such that the retractor 143 is operable to drive the bolt head 222 between the extended and retracted positions. Formed within the bolt head 222 is a longitudinal channel 223 in which at least a portion of the DPS assembly 250 is seated.

The deadlatch plunger 230 is positioned adjacent the bolt head 222 and is operably connected with the deadlock mechanism 240. Depression of the deadlatch plunger 230 activates the deadlock mechanism 240, thereby causing the deadlock mechanism 240 to prevent externally-applied pushing forces from moving the latchbolt 220 to its retracted position while permitting the retractor 143 to retract the latchbolt 220. Such deadlock mechanisms are known in the art, and need not be described in further detail herein.

The DPS assembly 250 is seated in the channel 223, and generally includes a tubular shell 252 having a laterally-outer end and a laterally-inner end, a magnetic sensor 254 mounted in the outer end of the shell 252, and a pair of wires 256 extending from the magnetic sensor 254 and out of the inner end of the shell 252. The laterally-outer end of the shell 252 has projecting therefrom a tab 253 that is sandwiched between the inner faceplate 214 and the outer faceplate 216 to retain the axial position of the DPS assembly 250. For example, the tab 253 may be seated in a recess 215 formed in the inner faceplate 214. The shell 252 protects the wires 256 from interfering with extension and retraction of the bolt head 222, during which movement the channel 223 slides along the tubular shell 252. The magnetic sensor 254 is operable to sense the magnetic field generated by the magnet 84, and the wires 256 provide a line of communication between the sensor 254 and the control assembly 126 and/or an external device such that the control assembly 126 and/or the external device is operable to receive information transmitted by the sensor 254.

When the door 90 is in the closed position, the magnetic sensor 254 is aligned with and in close proximity to the strike-mounted magnet 84. When the door 90 is open, by contrast, the magnetic sensor 254 and the magnet 84 are misaligned and are relatively distant from one another. As such, the magnetic field sensed by the sensor 254, and thus the output of the sensor 254, will be different when the door 90 is in the open position as compared to the output of the sensor 254 when the door 90 is in the closed position. Accordingly, the output of the sensor 254 can be utilized to determine the open/closed position of the door 90.

In certain forms, the sensor 254 may be provided as a binary switch, such as a reed switch or Hall switch. In other forms, the sensor 254 may be a sensor operable to generate a continuous range of outputs related to the strength of the sensed magnetic field, such as a Hall effect sensor or a magnetometer. In either event, the output of the sensor 254 corresponds to the open/closed position of the door 90, and accordingly may be utilized to determine the open/closed position of the door 90.

Figure 5:
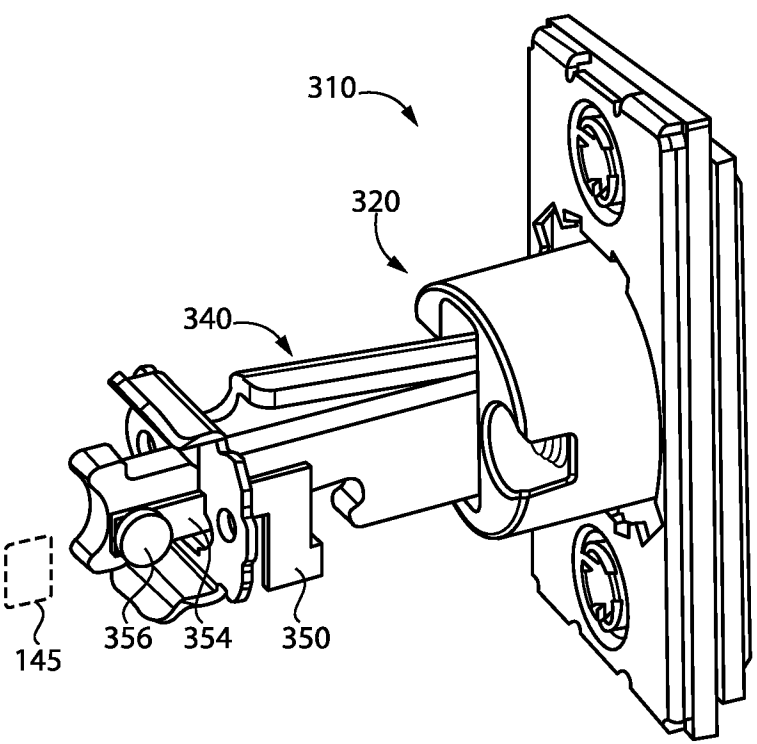
FIG. 5 is a second perspective view of the latchbolt assembly illustrated in FIG. 4.
Figure 4:
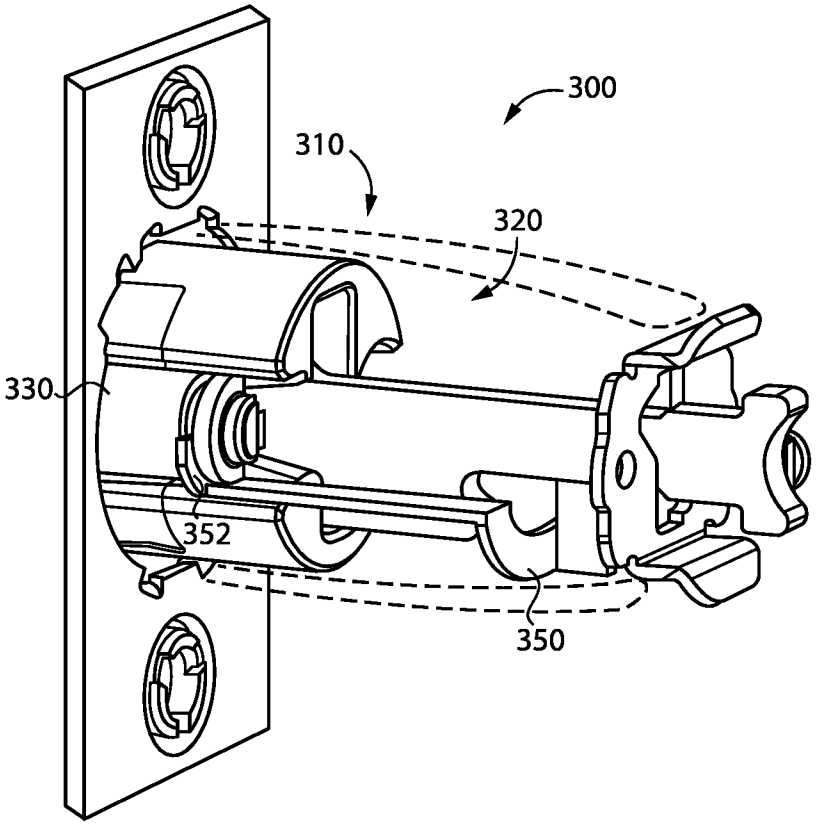
FIG. 4 is a first perspective view of a latchbolt assembly according to certain embodiments.

With reference to FIGS. 4 and 5, illustrated therein is a latchbolt assembly 300 according to certain embodiments, which may be utilized as the latchbolt assembly 130 of the lockset 100. For example, the chassis assembly 140 may include a door position sensor 145 in the form of a magnetic sensor, and the latchbolt assembly 130 may be provided in the form of the latchbolt assembly 300. The latchbolt assembly 300 generally includes a housing 310, a latchbolt 320, a deadlatch plunger 330, and a deadlock mechanism 340, each of which is substantially similar to the corresponding component described above with reference to FIGS. 1-3. In the interest of conciseness, the following description of the latchbolt assembly 300 focuses primarily on elements and features that differ from those described above with reference to the latchbolt assemblies 130, 200.

Connected to the rear or laterally-inner side of the deadlatch plunger 330 is a link 350 having a first end 352 and an opposite second end 354 that faces the chassis assembly 140. A magnet 356 is mounted to the second end 354 of the link 350, and the first end 352 of the link 350 is secured to the deadlatch plunger 330 such that the link 350 moves with the plunger 330 between the projected position and the depressed position. As a result, movement of the plunger 330 between the projected position and the depressed position moves the magnet 356 toward and away from the magnetic sensor 145 mounted within the chassis 140. The magnet 356 is therefore operable to alter the output signal of the magnetic sensor 145.

As noted above, the deadlatch plunger 330 is biased toward its projected position, and is retained in its depressed position when the door 90 is in its closed position. Accordingly, the open/closed position of the door 90 can be inferred based upon the position of the plunger 330. Additionally, the position of the magnet 356 corresponds to that of the plunger 330, and the output of the sensor 145 corresponds to the position of the magnet 356. The output of the sensor 145 therefore generally corresponds with the open/closed position of the door 90, and may be utilized to infer the open/closed position of the door 90.

One issue that may arise with the arrangement illustrated in FIGS. 4 and 5 is the issue of false positive reporting. When the door 90 is open, for example, retraction of the latchbolt 320 by one of the handles 114, 124 also causes the plunger 330 to move to its depressed position, thereby causing the sensor 145 to indicate that the door 90 is in the closed position. Such false positives may be mitigated by incorporation of a request to exit (REX) sensor that detects when the retractor 143 is retracted. For example, determination of the door position may involve determining that the door 90 is closed when the output from the magnetic sensor 145 indicates that the plunger 330 is depressed while the REX sensor indicates that the retractor 143 has not caused such depression.

Figure 7:
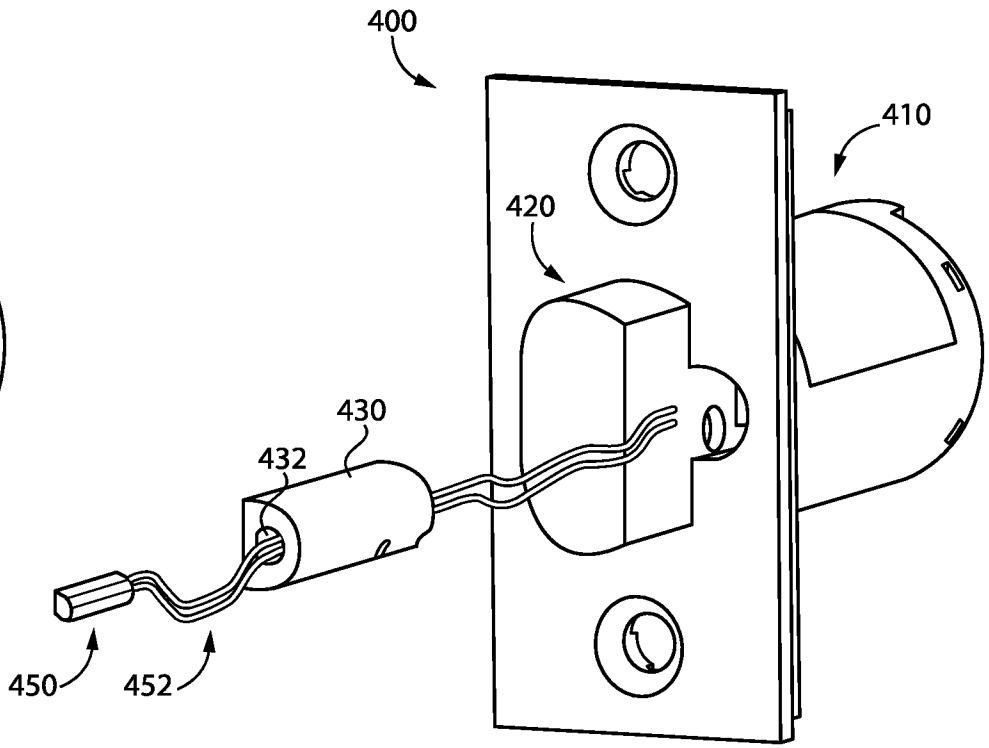
FIG. 7 is a partially-exploded view of the latchbolt assembly illustrated in FIG. 6.
Figure 6:
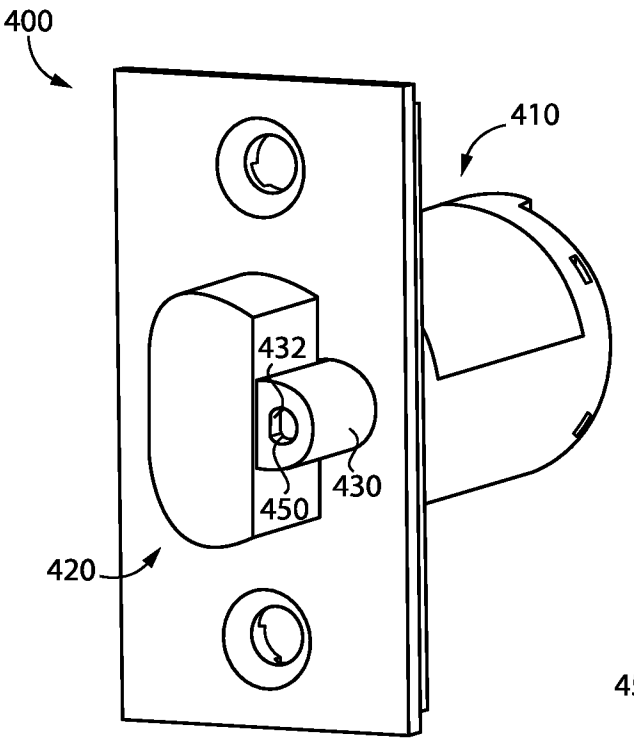
FIG. 6 is a perspective view of a latchbolt assembly according to certain embodiments.

With additional reference to FIGS. 6 and 7, illustrated therein is a latchbolt assembly 400 according to certain embodiments. The latchbolt assembly 400 may be utilized as the latchbolt assembly 130 of the lockset 100, for example in embodiments in which the strike 80 includes the magnet 84. The latchbolt assembly 400 generally includes a housing 410, a latchbolt 420, a deadlatch plunger 430, a deadlock mechanism, and a magnetic sensor 450, each of which is substantially similar to the corresponding component described above with reference to FIGS. 1-5. In the interest of conciseness, the following description of the latchbolt assembly 400 focuses primarily on elements and features that differ from those described above with reference to the latchbolt assemblies 130, 200, 300.

The deadlatch plunger 430 has an opening 432 extending therethrough, and the magnetic sensor 450 is seated in the opening 432. Wires 452 extend through the housing 410 and are connected with the control assembly 126 and/or an external device such that the control assembly 126 and/or the external device is operable to receive the door position information transmitted by the sensor 450.

When the door 90 is in the closed position, the magnetic sensor 450 is aligned with and in close proximity to the strike-mounted magnet 84. When the door 90 is open, by contrast, the magnetic sensor 450 and the magnet 84 are misaligned and are relatively distant from one another. As such, the magnetic field sensed by the sensor 450, and thus the output of the sensor 450, will be different when the door 90 is in the open position as compared to the output of the sensor 450 when the door 90 is in the closed position. Accordingly, the output of the sensor 450 can be utilized to determine the open/closed position of the door 90.

Figure 9:
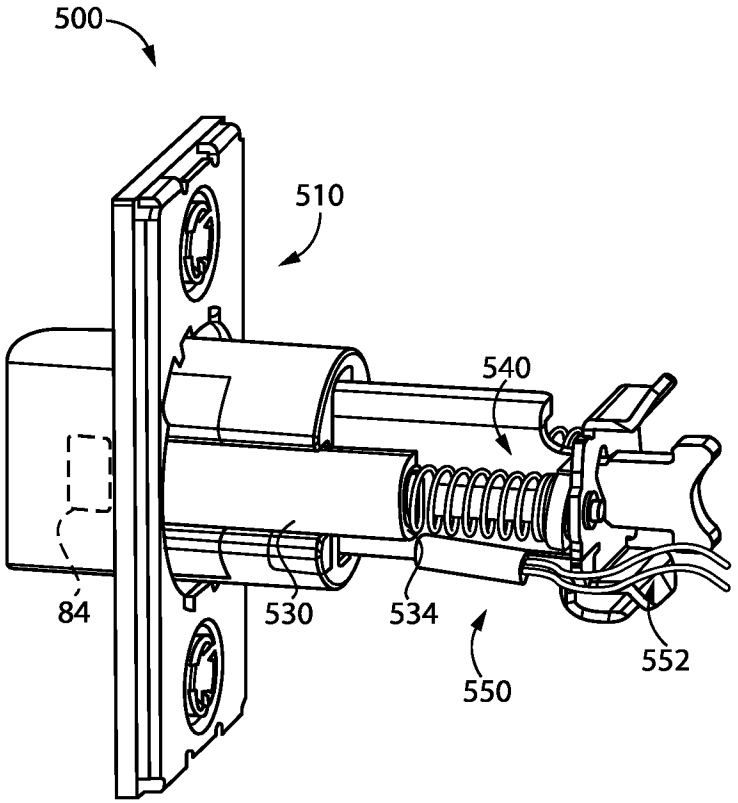
FIG. 9 is a perspective view of the latchbolt assembly illustrated in FIG. 8 with the plunger in a depressed position.
Figure 8:
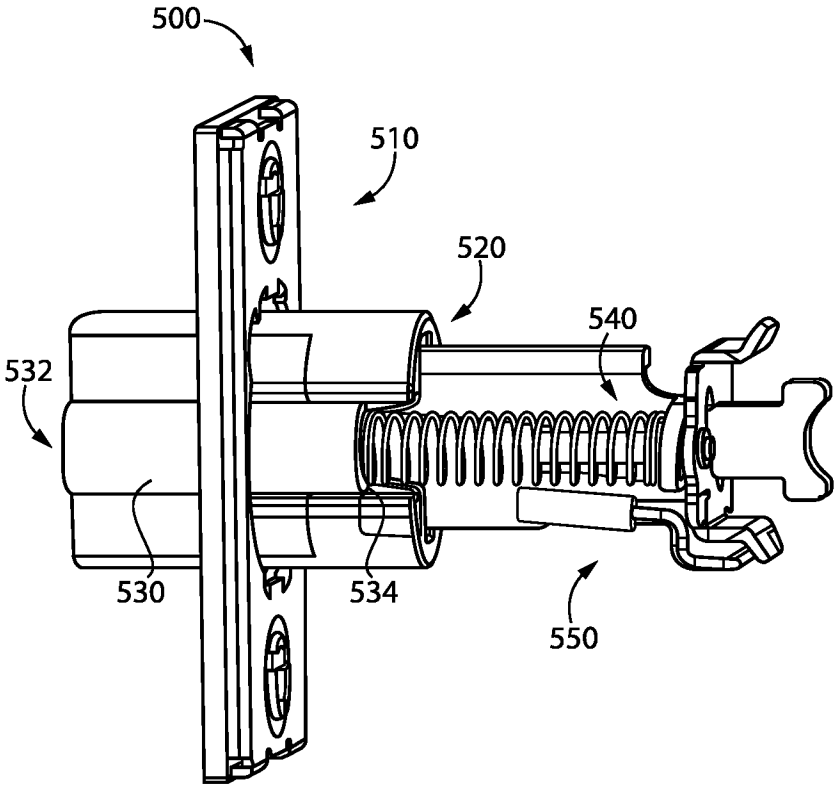
FIG. 8 is a perspective view of a latchbolt assembly with a plunger in a projected position.

With additional reference to FIGS. 8 and 9, illustrated therein is a latchbolt assembly 500 according to certain embodiments. The latchbolt assembly 500 may be utilized as the latchbolt assembly 130 of the lockset 100, for example in embodiments in which the strike 80 includes the magnet 84. The latchbolt assembly 500 generally includes a housing 510, a latchbolt 520, a deadlatch plunger 530, a deadlock mechanism 540, and a magnetic sensor 550, each of which is substantially similar to the corresponding component described above with reference to FIGS. 1-7. In the interest of conciseness, the following description of the latchbolt assembly 500 focuses primarily on elements and features that differ from those described above with reference to the latchbolt assemblies 130, 200, 300, 400.

As noted above, the open/closed position of the door 90 can reasonably be inferred based upon the projected/depressed position of the plunger 530. The plunger 530 has a front end 532 that engages the strike 80 when the door 90 is in the closed position, and an opposite rear end 534. In the illustrated form, the magnetic sensor 550 is seated in the housing 510, and wires 552 extend through the housing 510 for connection with the control assembly 126 and/or an external device. The sensor 550 is positioned in the housing 510 such that the sensor 550 is in close proximity to the rear end 534 when the plunger 530 is in the depressed position.

When the door 90 is in its closed position, the plunger 530 is retained in its depressed position due to engagement with the strike 80, and the magnet 84 is in close proximity to the front end 532 of the plunger 530. The plunger 530 is formed of a magnetizable (e.g., ferrous) material such that magnetic flux is transmitted along the length of the plunger 530. With the rear end 534 in close proximity to the magnetic sensor 550, this magnetic flux alters the output of the sensor 550. For example, in embodiments in which the sensor 550 is provided as a reed switch, the magnetic flux causes the reed switch to transition from one of an open position or a closed position to the other of the open position or the closed position.

Both the current embodiment and the embodiment described above with reference to FIGS. 4 and 5 vary the output of the sensor based at least in part upon the position of the plunger. However, the current embodiment may aid in preventing false positives that may be present in the arrangement illustrated in FIGS. 4 and 5, in which the output of the sensor 145 depends only upon the position of the plunger 330. In the case that the plunger 530 has been retained to its depressed position by the retractor 143 while the door 90 is open, the front end 532 of the plunger 530 will not be proximate the magnet 84. As a result, magnetic flux will not be transmitted to the rear end 532 of the plunger 530, and the magnetic sensor 550 will not be actuated. Thus, the output of the sensor 550 will remain constant or substantially constant should the latchbolt assembly 500 be actuated while the door 90 is in its open position.

As should be evident from the foregoing, described herein are several embodiments of latchbolt assemblies operable to aid in detecting the position of the door 90. In certain forms, the latchbolt assemblies described herein are configured for mounting in the standard latch bore 97 such that the installer need not form additional bores in the door 90 or modify the door 90 in any manner. In certain forms, the latchbolt assemblies described herein may be sold as standalone units. In other embodiments, the latchbolt assemblies may be provided in a system including other components of the lockset 100 and/or the strike plate 80.

While the embodiments described hereinabove relate to spring-loaded latchbolt assemblies in which the latchbolt is biased toward its extended position, it is also contemplated that the concepts described herein may be utilized in connection with deadbolts, which typically are not spring-biased to their extended positions. For example, a deadbolt assembly may include a deadbolt having a channel in which a sensor is seated in the manner described above with reference to FIGS. 2 and 3.

Additionally, while each of the latchbolt assemblies described hereinabove includes a deadlock mechanism actuated by a deadlatch plunger, it is also contemplated that the deadlock mechanism and/or the plunger may be omitted. In the latchbolt assembly 200, for example, the plunger 230 is not required for sensing of the door position, and can be omitted in certain embodiments. For those embodiments that do include a plunger, the plunger may not necessarily be engaged with a deadlock mechanism, and may instead be provided merely to aid in sensing the position of the door 90. Thus, the embodiments illustrated in FIGS. 4-9 may omit the deadlock mechanisms while retaining the plungers thereof.

Certain embodiments of the present application relate to a method of installing and operating the lockset 100. The method may involve installing the lockset 100 to a door 90 including a standard door preparation 95 without modifying the door 90 (e.g., by drilling holes into the door 90). With the lockset 100 installed, the method further includes transmitting to the control assembly 126 (or an external device) an output signal from one or both of the magnetic sensors 135, 145 such that the output signal varies according to the open/closed position of the door 90, and inferring the open/closed position of the door 90 based upon the output signal.

In certain embodiments, the output signal may vary based at least in part upon the position of the plunger 133. For example, in embodiments in which the latchbolt assembly 130 is provided in the form of the latchbolt assembly 300, the output signal may vary based only upon the position of the plunger 330. In embodiments in which the latchbolt assembly 130 is provided in the form of the latchbolt assembly 500, however, the output signal varies based upon the position of the plunger 530 and the proximity of the front end 532 to the strike-mounted magnet 84. In either event, the open/closed position of the door 90 can be inferred based at least in part upon the output signal.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A bolt assembly for use with a lock associated with a door, comprising:

a bolt configured for movement between an extended position and a retracted position; and a magnetic sensor positioned adjacent a head of the bolt and at least partially positioned within a longitudinal channel in the bolt, and wherein the magnetic sensor is operable to transmit information relating to an open/closed position of the door, wherein at least a portion of the magnetic sensor is displaced relative to the channel in the bolt during movement of the bolt between the extended position and the retracted position.

2. The bolt assembly of claim 1, wherein at least a portion of the magnetic sensor slides along the channel in the bolt during movement of the bolt between the extended position and the retracted position.

3. The bolt assembly of claim 1, wherein the magnetic sensor is displaced during the movement of the bolt between the extended position and the retracted position.

4. The bolt assembly of claim 1, wherein the magnetic sensor senses magnetic flux generated by a magnet mounted to a door strike when the bolt is in the extended position and positioned within an opening in the door strike.

5. The bolt assembly of claim 1, further comprising a housing including a tubular sleeve configured for mounting in a latch bore of a door.

6. The bolt assembly of claim 5, wherein the magnetic sensor includes wires that extend through the tubular sleeve.

7. The bolt assembly of claim 5, wherein the housing further comprises a first faceplate secured to the tubular sleeve and a second faceplate secured to the first faceplate; and wherein the magnetic sensor includes a tab projecting therefrom that is captured between the first faceplate and the second faceplate.

8. A bolt assembly for use with a lock associated with a door, comprising:

a bolt configured for movement between an extended position and a retracted position; and a magnetic sensor positioned adjacent a head of the bolt and at least partially positioned within a longitudinal channel in the bolt, and wherein the magnetic sensor is operable to transmit information relating to an open/closed position of the door, wherein the magnetic sensor remains stationary during the movement of the bolt between the extended position and the retracted position.

9. A bolt assembly for use with a lock associated with a door, comprising:

a latchbolt configured for movement between an extended position and a retracted position;

a dead latch plunger positioned adjacent the latchbolt and engaged with a deadlock mechanism to prevent externally-applied pushing forces from moving the latchbolt to the retracted position; and a magnetic sensor positioned adjacent a head of the latchbolt and at least partially positioned within a longitudinal channel in the latchbolt, and wherein the magnetic sensor is operable to transmit information relating to an open/closed position of the door.

10. A bolt assembly for use with a lock associated with a door, comprising:

a latchbolt assembly comprising:

a latchbolt having an extended position and a retracted position; and a dead latch plunger positioned adjacent the latchbolt and comprising a magnetizable member having a front end portion and an opposite rear end portion, the front end portion configured for receipt within an opening in a strike when the door is in a closed position; and a magnetic sensor positioned adjacent the rear end portion of the magnetizable member;

wherein magnetic flux generated by a magnet in the strike is transmitted from the front end portion of the magnetizable member to the rear end portion when the front end portion is received in the opening in the strike; and wherein the magnetic flux transmitted along the magnetizable member is sensed by the magnetic sensor to generate information relating to an open/closed position of the door.

11. The bolt assembly of claim 10, wherein the dead latch plunger is engaged with a deadlock mechanism to prevent externally-applied pushing forces from moving the latchbolt to the retracted position.

12. The bolt assembly of claim 11, wherein the front end portion of the dead latch plunger is positioned in close proximity to the magnet when the front end portion is received in the opening in the strike, and wherein the rear end portion of the dead latch plunger is positioned in close proximity to the magnetic sensor such that the magnetic flux is transmitted from the magnet to the magnetic sensor by way of the dead latch plunger.

13. A bolt assembly for use with a lock associated with a door, comprising:

a latchbolt assembly having an extended position and a retracted position, the latchbolt assembly including a magnetizable member having a front end portion and an opposite rear end portion, the front end portion configured for receipt within an opening in a strike when the door is in a closed position; and a magnetic sensor positioned adjacent the rear end portion of the magnetizable member, wherein the magnetic sensor remains in a stationary position as the latchbolt assembly is transitioned between the extended position and the retracted position;

wherein magnetic flux generated by a magnet in the strike is transmitted from the front end portion of the magnetizable member to the rear end portion when the front end portion is received in the opening in the strike; and wherein the magnetic flux transmitted along the magnetizable member is sensed by the magnetic sensor to generate information relating to an open/closed position of the door.

14. A bolt assembly for use with a lock associated with a door, comprising:

a latchbolt assembly having an extended position and a retracted position, the latchbolt assembly including a plunger having a projected position and a depressed position;

a link having a first end and an opposite second end, the first end of the link secured to the plunger, and the second end of the link including a magnet generating magnetic flux; and a magnetic sensor;

wherein movement of the plunger between the projected position and the depressed position moves the link and the magnet toward and away from the magnetic sensor to thereby vary an amount of the magnetic flux sensed by the magnetic sensor and alter an output signal of the magnetic sensor;

wherein the latchbolt assembly includes a latchbolt and a latchbolt retractor operable to drive the latchbolt between the extended position and the retracted position, and wherein the bolt assembly further comprises a request to exit sensor operable to detect movement of the latchbolt retractor independent from movement of the latchbolt; and wherein a determination of a closed position of the door comprises a first indication from the magnetic sensor regarding displacement of the plunger to the retracted position and a second indication from the request to exit sensor that the latchbolt retractor did not cause the displacement of the latchbolt to the retracted position.

15. The bolt assembly of claim 14, wherein the plunger comprises a dead latch plunger.

16. The bolt assembly of claim 14, wherein the magnetic sensor remains in a stationary position relative to the plunger as the plunger is transitioned between the projected position and the depressed position.

* * * * *